United States Patent [19]

Baumann

[11] 4,048,266

[45] Sept. 13, 1977

[54] AIR BUBBLING MAT FOR USE IN BATHTUBS FOR PRODUCING BUBBLING AND FULL-FOAM BATHS

[76] Inventor: Ludwig G. Baumann, Ch 9527 Im Reckholder, Niederhelfenschwil, Switzerland, CH9527

[21] Appl. No.: 597,353

[22] Filed: July 21, 1975

[30] Foreign Application Priority Data

| | | |
|---|---|---|
| Aug. 30, 1974 | Germany | 2441686 |
| Nov. 11, 1974 | Germany | 2453291 |

[51] Int. Cl.[2] ..... B01F 3/04

[52] U.S. Cl. ..... 261/122; 4/180; 128/66; 261/124; 261/DIG. 26

[58] Field of Search ..... 261/122, DIG. 26, 123, 261/124, 64 R; 4/180, 185 AB, 185 HB, 185 R, 185 S; 128/66

[56] References Cited

U.S. PATENT DOCUMENTS

| | | | |
|---|---|---|---|
| 2,637,541 | 5/1953 | Rubin | 261/122 |
| 2,719,307 | 10/1955 | Reid | 4/180 |
| 2,793,640 | 5/1957 | Schwartz | 4/180 X |
| 3,031,685 | 5/1962 | Baumann | 4/180 |
| 3,076,976 | 2/1963 | Bogar | 261/124 X |
| 3,240,208 | 3/1966 | Everston | 4/180 X |
| 3,299,885 | 1/1967 | Wessel | 4/180 X |
| 3,367,325 | 2/1968 | O'Keefe | 4/180 X |
| 3,443,560 | 5/1969 | Munroe et al. | 4/180 X |
| 3,710,786 | 1/1973 | Rico et al. | 4/180 X |
| 3,814,399 | 6/1974 | Melreit | 261/124 |
| 3,870,040 | 3/1975 | Kulisch | 4/180 X |

*Primary Examiner*—Tim R. Miles
*Assistant Examiner*—Richard L. Chiesa
*Attorney, Agent, or Firm*—McGlew and Tuttle

[57] ABSTRACT

The mat is arranged to be connected to an air distribution device and a blower, and comprises a substantially rectangular, flat, and relatively elongated hollow body of a suitable material, such as plastic or rubber, with upper and lower walls forming, respectively, upper and lower support surfaces for a patient's body, and interconnected by side and end walls. The body has an upper portion, including the upper wall, formed with a plurality of air chambers and with air passages, and a lower portion, including the lower wall, having ribs or elevations extending therefrom. The upper wall is pressure-formed to define a plurality of channels or grooves extending longitudinally and centrally of the body and a plurality of channels or grooves extending laterally outwardly from the central grooves or channels. The bases of these grooves are formed with perforations opening through the upper wall. An air distributing manifold is incorporated in the body and the air passages establish at least partial communication between the air chambers and further establish electrically controllable communication between individual air chambers and the manifold. Further elongated chambers extend along each longer peripheral edge of the body, and have perforations directed through the side walls closely adjacent to the lower wall of the body. In one embodiment, respective coupling sleeves are provided on the upper and lower walls at the manifold, with one coupling sleeve communicating with the central and laterally extending chambers and the other coupling sleeve communicating with the chambers extending along the longer edge of the body. In another embodiment of the invention, two coupling sleeves are provided on the upper wall of the body, one communicating with the centrally and laterally extending air chambers and the other communicating with the air chambers extending along the longer peripheral edges of the body. If the body is made of fully flexible material, supports may be provided extending from the upper wall to engage the lower wall, and these supports are tapered in a downward direction.

4 Claims, 8 Drawing Figures

FIG.5
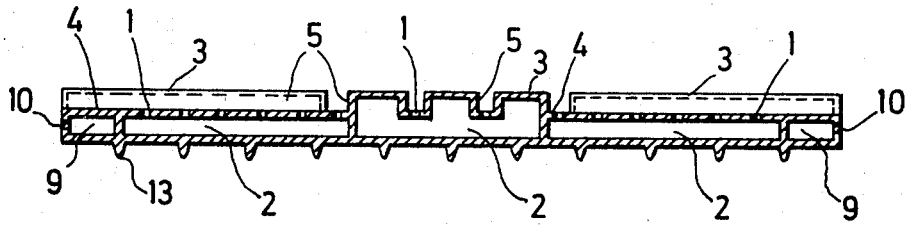
FIG.7
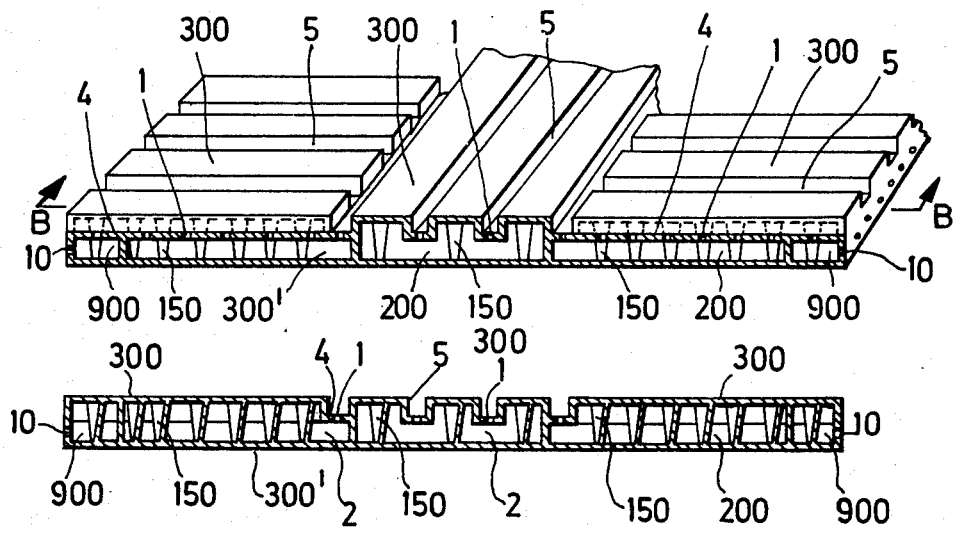
FIG.8

AIR BUBBLING MAT FOR USE IN BATHTUBS FOR PRODUCING BUBBLING AND FULL-FOAM BATHS

BACKGROUND OF THE INVENTION

The invention refers to a flexible or rigid double-walled air bubbling mat which can be connected with a blowing device, compressor or the like and which is suitable specially for bathtubs for preparing bubbling shower and foam baths.

DESCRIPTION OF THE PRIOR ART

In the case of the commonly known air bubbling mats, the air produced by the blowing device is directed through an air distributing head into flexible tubes or tube-like channels which are embedded lengthwise in the mat or are an essential part of it and have a plurality of holes which are directed towards the patient's body to impinge the same with air bubbles.

However, the treatment with air bubbles is adversely affected by the fact that, at the ends of the tubes, the compressed air suffers a pressure loss. Already, small changes in the horizontal position of the mat and, consequently, of the water pressure in the tube, are sufficient to make the exit of the air bubbles, at important points of the tubes, problematic. To remedy this drawback, a very expensive and hardly successful design has been provided with air exit holes which have unequal diameters at the important points of the mat.

To overcome the above-mentioned and other deficiencies of existing similar appliances, in the mat embodying the present invention, the air, as to volume and pressure, is distributed over the entire area of the mat uniformly. Considering the size of such a mat, this is possible only if the individual, or groups of, individual, air chambers are individually supplied through valves of an air distributing manifold. Also, there must be provided a separate supply of air into some groups of chambers corresponding to certain parts of the patient's body, for example, back, buttocks, legs, etc., for which purpose particular control mechanisms of the distributing manifold are to be used. Furthermore the ingenious design of the mat makes it possible that the mat can be used as an underwater air bubbling mat and also as a mat for producing a full foam bath while the patient's body reposes on a dry surface.

SUMMARY OF THE INVENTION

The characteristic feature of the invention consists in the fact that a number of air chambers, perforated upwards and running in various directions, are provided, considered in the longitudinal and/or cross section of a double-walled air bubbling mat and preferably are partially connected and bunched with one another in an air-conducting way. The air chambers further communicate, completely or partly, in groups or individually, with an air distributing manifold, for example, through a multi-way cock, a flap system, a gate valve system, or a rotary valve system, which manifold is associated with the mat and supplied from a blower, in a selectively controllable manner. In a development of the invention, the perforations of the air chambers, intended for forming the air bubbles which pass into the bath water, are aligned along straight or curved lines in the longitudinal, transverse, or other directions of the top surface of the mat, and are provided in the bottom of correspondingly extending grooves or channels which form depressions in the mat surface. The invention makes it possible to connect part of the air chambers in such a way that the bubbles are focused on the locations of the recurring trouble such as haemorrhoidal tissues, interarticular discs, etc.

In a further development of the invention, separated or continuous air chambers are provided in the area of the longitudinal edges and, if desired, in the free, foot end edge of the mat. These air chambers have fine perforations directed upwards downwards or laterally outwards, and can be charged separately with air by means of the air distributing manifold. These perforations are arranged in such a way that, for preparing only a full-foam bath with the lowest water level and with the patient's body reposing on a dry surface, the edge perforations lie below the water surface while the rest surface is above the water level. This makes it possible to provide an underwater surface bubbling by shutting off the chambers adjacent the edges, or to produce a full-foam bath while supplying the edge chambers.

For an understanding of the principles of the invention, reference is made to the following description of typical embodiments thereof as illustrated in the accompanying drawings.

BRIEF DESCRIPTION OF THE DRAWINGS

In the drawings:

FIG. 5 is a sectional view of the air bubbling mat, on line 5—5, of FIG. 1;

FIG. 7 is a partial part perspective cross section view of the mat on the level of the perforations which are used for the formation of air bubbles; and FIG. 8 is a cross section of the air bubbling mat, on the line B—B, of FIG. 7.

DESCRIPTION OF THE PREFERRED EMBODIMENT

Figures 1, 2:
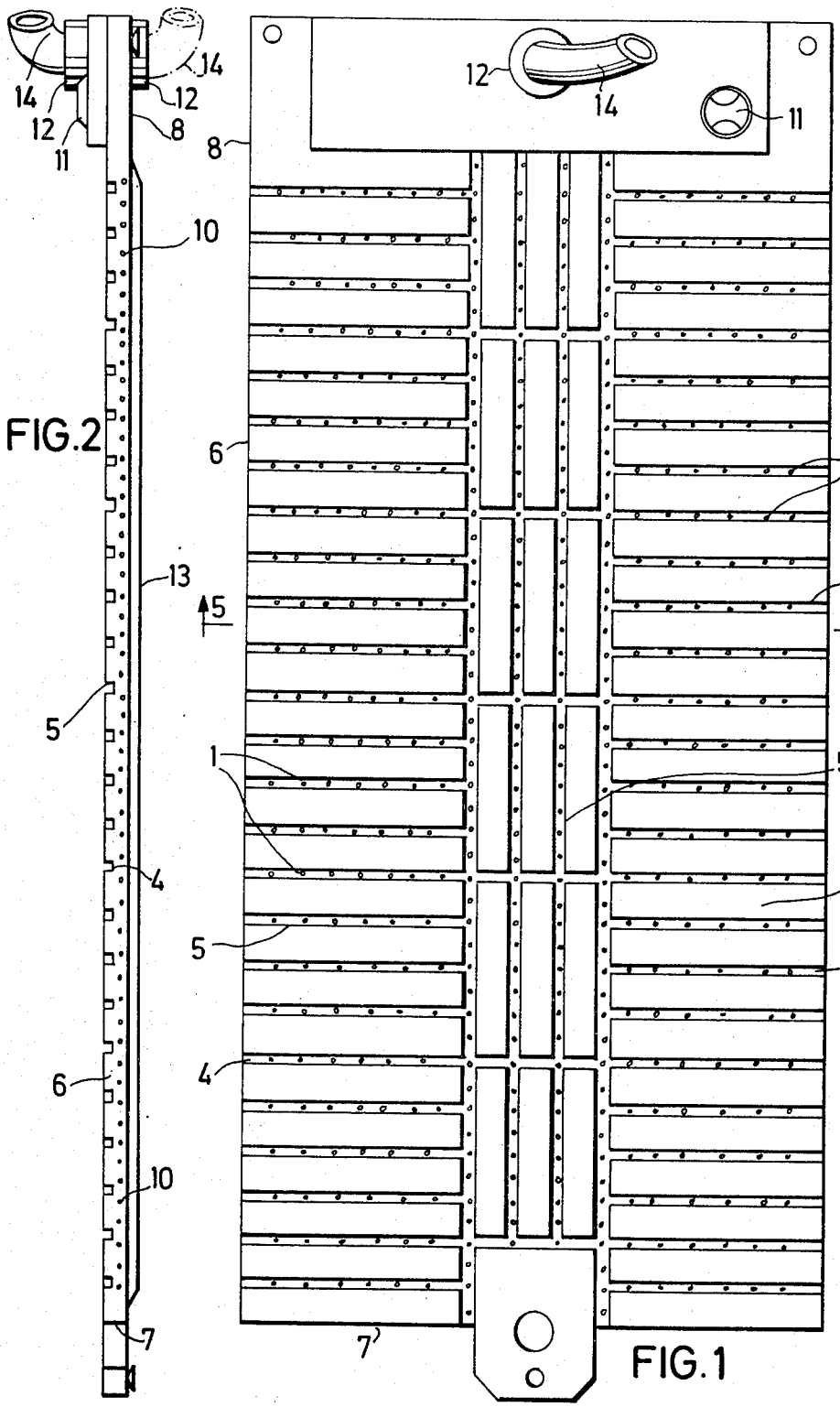
FIG. 1 is the top plan view on an air bubbling mat comprising coupling sleeves on both sides for alternate connection to an air hose connected to a blowing device.
FIG. 2 is a side elevation view of FIG. 1

As shown in FIG. 1, an air bubbling mat 8 comprises an approximately rectangular, flat, hollow and relatively elongated body which may be accommodated in a bathtub and the upper and lower parts of which are air-tightly connected to each other in the border zones. The substantial feature of the mat, however, as shown particularly in FIG. 5 is that, in the interior of the hollow body, which is made of plastic, relatively voluminous air chambers 2 and 9 are formed which are relatively resistant to deformation and preferably produced, by vacuum deformation of the top side 3. These air chambers are perforated in the direction of the useful surface of the air bubbling mat 8 and they are in air-conducting connection individually or in groups with an air distributing manifold 11 provided at one end of the mat and supplied by a blowing device or the like so that thousands of more or less voluminous air bubbles which are distributed over the whole surface of the mat 8 can be directed against the affected parts of the patient's body. According to the intended purpose it is possible to arrange the air chambers 2 in any direction that will suit and in straight or curved path or lines. For example, a part of the air chambers 2 can be grouped in such a way that the bubbles are focused on the location of recurring troubles of the patient's body, such as haemorrhoidal tissue, interarticular discs, etc.

Figure 6:
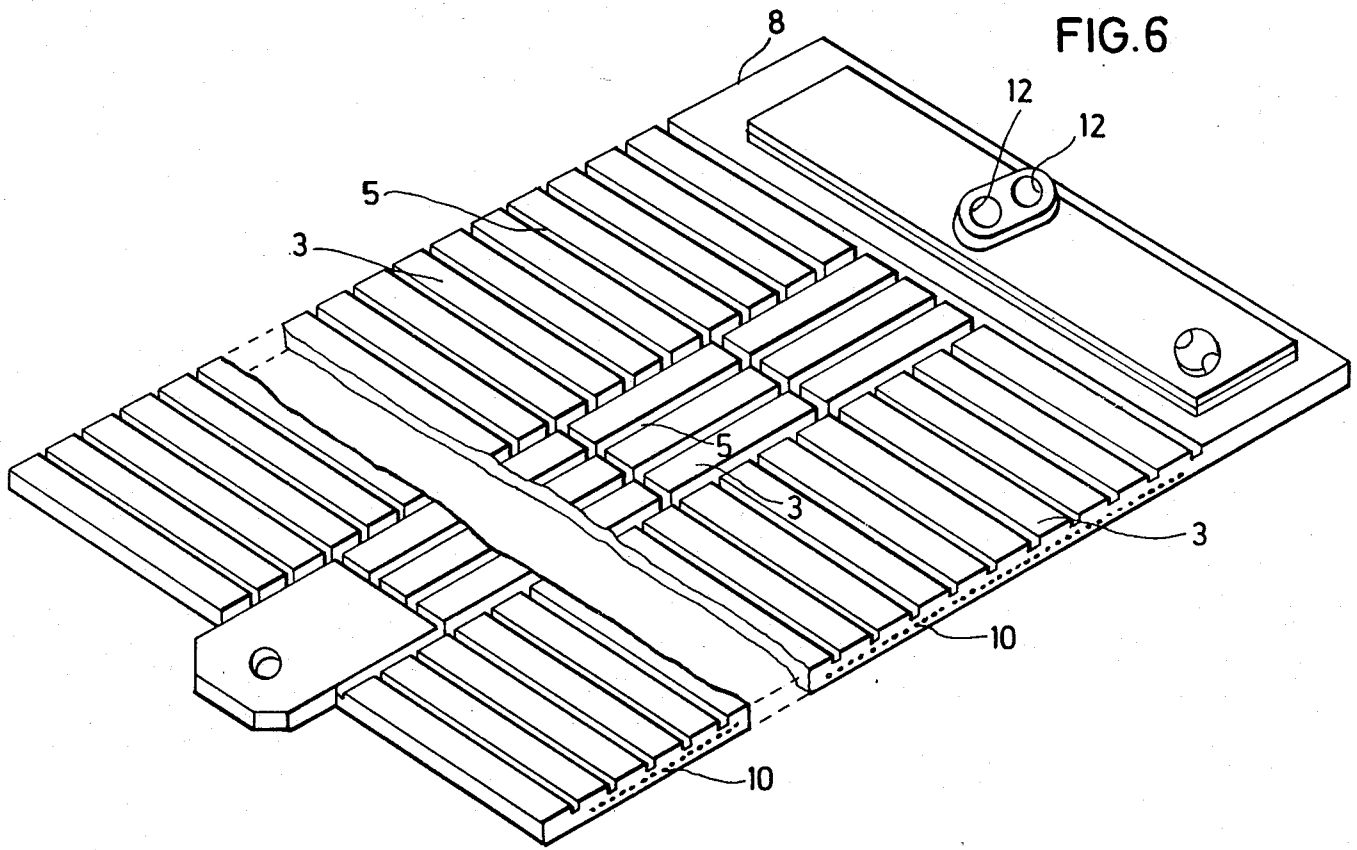
FIG. 6 is a perspective view of the mat, with both coupling sleeves provided on the top side of the mat, so that either an underwater air bubbling or a full-foam bath may be provided without inverting the mat.

In the embodiments of FIGS. 1, 5, 6, the air chambers 2 are arranged in parallel juxtaposition in the longitudinal direction of mat 8. The perforations 1, serving as outlets for the air bubbles are arranged, in conformity with the invention.

The bottom 4 of grooves 5 are impressed in the top surface 3 of the air bubbling mat 8.

In the embodiments of FIGS. 1 and 6, there are arranged four grooves 5 extending centrally of the longitudinal axial direction of the air bubbling mat 8 and, at either side cross-grooves 5 are provided extending perpendicularly to the first-mentioned grooves 5 and opening freely into two longitudinally edge surfaces 6 of mat 8 as well as into the central longitudinal grooves which, in turn, open freely into the transverse edge surface 7 at the foot end of the mat. These open ends of the grooves prevent damming up of the air at some locations should a corpulent patient block the edges while taking a bubbling bath.

In the event that only the vertebral column of the patient's body is to be treated intensively, the compressed air is directed only into the center longitudinal air chamber 2, by adjusting properly the air distributing manifold 11, and the air escapes through the two longitudinal grooves 5 which are placed there side by side. By an additional adjustment of the air distributing manifold 11, the center longitudinal air chamber 2 may be shut off and air chambers 2 adjacent thereto and communicating, through perforations, with two lateral longitudinal grooves 5 and the respective transverse grooves 5 at each side, as shown in FIG. 5. This results in an underwater bubbling.

As appears from FIG. 5, additional air chambers 9 are provided at the two longitudinal edges 6 and, if desired, also at the foot-end cross-edge 7 of the air bubbling mat 8, and these air chambers have perforations 10 directed laterally outward. It is thus possible to produce a full foam bath while the patient's body reposes on a dry surface, because only as mach water is supplied to the tube as will flood perforations 10. In this case, the top surface of bubbling mat 8 remains dry.

For producing selectively a multiple underwater air bubbling or a full-foam bath with a dry rest surface with one and the same device, two embodiments are provided, as shown, for example, in FIGS. 1 through 5 and in FIG. 6.

Figure 3:
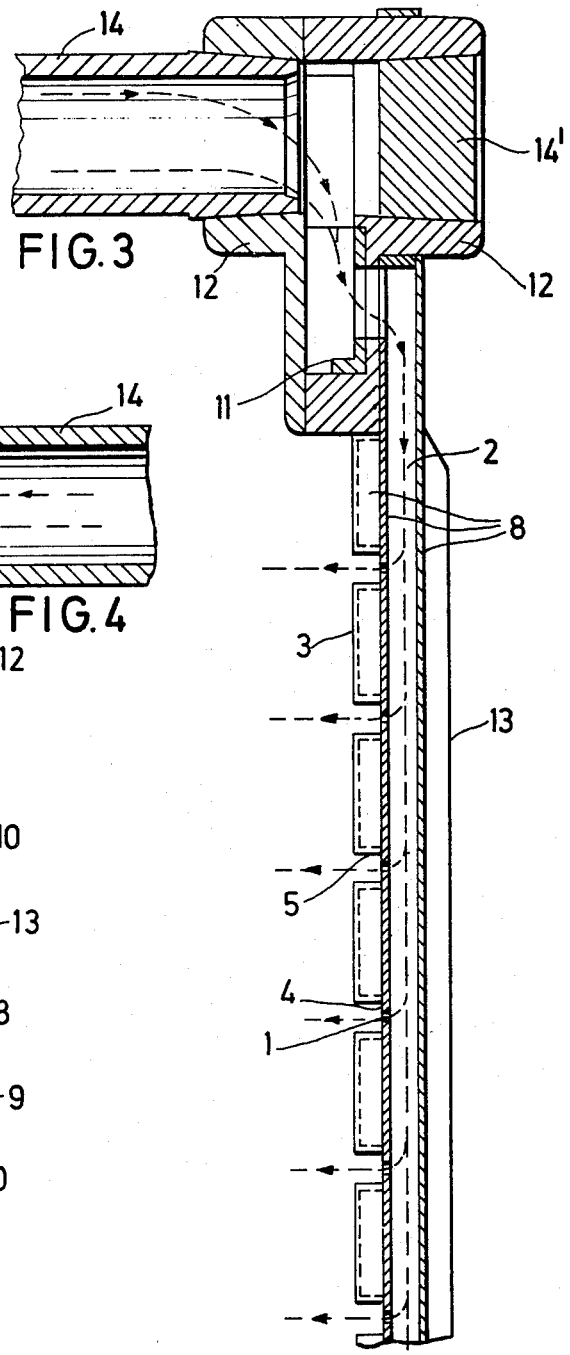
FIG. 3 is a longitudinal section through the air bubbling mat in the area of the air distributing manifold where the air hose coming from the blowing device is introduced in the sleeve of the top side of the air bubbling mat.

According to the version of FIGS. 1, 2, 3 and 4, the air distributing manifold 11 comprises respective coupling sleeves sleeve 12 on both its top side and its underside. If mat 8 is used only for producing an underwater bubbling treatment, flexible tube 14 to the blowing device is engaged into the coupling sleeve 12 on the top side of the mat 8, as shown in FIGS. 1 and 2 while the coupling sleeve 12 on the bottom of the mat 8 is closed by means of a plug of 14', as shown in FIG. 3. Then the air stream from the blowing device is directed selectively to the chambers 2.

Figure 4:
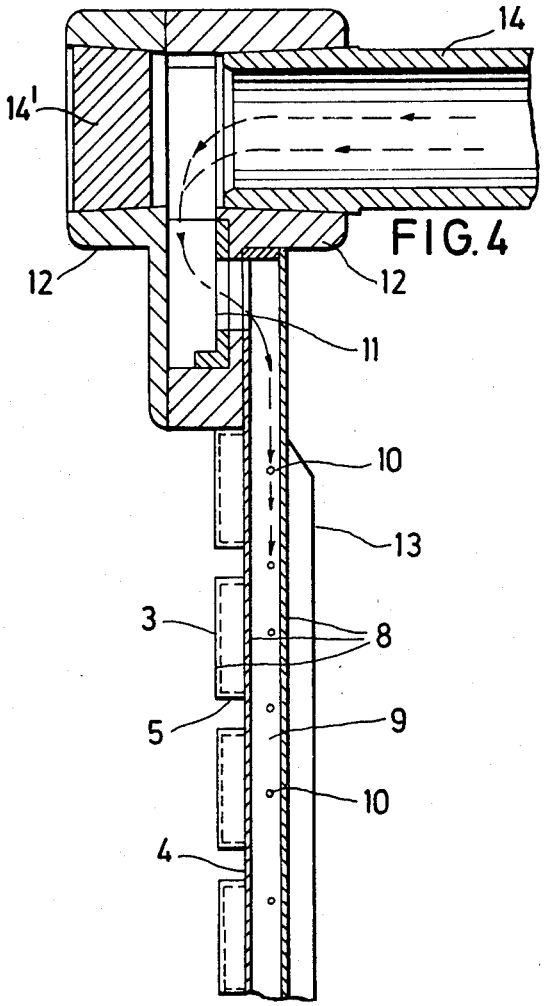
FIG. 4 is a view similar to FIG. 3, but with the air hose coming from the blowing device being connected in the sleeve on the underside of the mat for the purpose of preparing a full foam bath.

For producing a full foam bath mat 8 is inverted and the air tube 14 coming from the blowing device is engaged in the sleeve 12 on the bottom of the mat 8 (see FIG. 4). The air from the blowing device is thereby directed exclusively, through the air distributing manifold 11, into the air chambers 9, where it escapes through the perforations 10 which lie just below the water surface. The production of foam is intensive, while the patient's body reposes on the dry underside of the air bubbling mat, supported by projecting ribs or elevations 13 (FIG. 5).

The version of FIG. 6 offers a special advantage inasmuch as it is not necessary to invert the air bubbling mat since both coupling sleeves 12 are provided on the top side of the mat 8 and the perforations 10 if necessary for the production of a full foam bath, are located very low in the longitudinal edges of the mat. Only as much water is supplied into the bathtub as is necessary to flood the perforations 10 and to leave rest surface 3 of mat 8 dry. The compressed air from the blower is, supplied to the air distributing manifold 11 engaging the air tube 14 in one of the sleeves 12 while the neighboring sleeve 12 is closed by a plug 14'. As in the first embodiment the air is then conducted from manifold 11 to the air chambers 9 for producing a full foam bath or to the air chambers 2 for producing an underwater bubbling treatment.

For the purpose of improving the procedure, it is advisable to use, in FIG. 7 and 8, a soft material, chiefly soft rubber, for the mat surface 300 and the mat bottom 300' as well as for the partition walls arranged between the mat surface and the mat bottom in order to form the air chambers 200 and 900. A number of distance pieces 150 are provided within the air chambers 200 or 900. These pieces extend from the inner surface of the mat surface 300, in the main vertically, to the inner surface of the mat bottom 300', and they are arranged in such a way that, on the one hand, the air bubbling mat cannot be compressed by the weight of the patient while the transverse and longitudinal flexibility of the mat is maintained and that, on the other hand, the free air passage through the air chambers 200 and 900 is maintained in any bending position.

The distance pieces 150 can be developed as cylindrical, conic (such as represented in the drawing) cubic, or prismatic columns. Owing to this solution, the bathwater which may have entered into the air chambers 200 or 900 through the perforations of the mat top side 300 after stopping the blowing device has the possiblity to run off downwards in the hanging direction.

A further advantage of the invention is that, by inverting the mat, two different manners of treatment may be provided. The grooves 9, opening laterally through the apertures 10, prevent a buoyancy of the mat in the bathtub. With the air distributing manifold 11, any adjustment can be made and erroneous adjustments can be prevented. As stated, the mat may be made of plastic or rubber.

While specific embodiments of the invention have been shown and described in detail to illustrate the applications of the principles of the invention, it will be understood that the invention may be embodied otherwise without departing from such principles.

What is claimed is:

1. An air bubbling mat for use in a bathtub which can be selectively utilized to produce either a bubbling bath or a full-foam bath, comprising a substantially flat, elongated mat having opposed upper and lower walls forming respectively the upper and lower surfaces, opposed end and side walls interconnecting said upper and lower walls about the periphery of said upper and lower walls defining a hollow mat body, means disposed in said mat body to define a manifold chamber, said manifold chamber having an inlet means which is adapted to be connected to a source of compressed air, partition means disposed between said upper and lower walls to define therewith a plurality of air distributing channels through which air is distributed when said mat is utilized to produce a bubbling bath, said upper wall having a plurality of grooves formed on the surface thereof, said grooves extending transversely of each of said air distributing channels, and said grooves having a plurality of apertures formed therein disposed in communication with the associated air distributing channel through which the air distributed to said distributing channels flows when used to make a bubbling bath, and a second partition means disposed between said upper and lower walls and defining with said side walls separate foaming air channels, said side walls having a series of openings formed therein communicating with said foaming air channels through which air is permitted to flow outwardly from said mat when said mat is utilized as a full-foam bath mat, said manifold having a plurality of outlets, said outlets being respectively in communication with each of said plurality of air distributing channels and said foaming air channels, and means for selectively opening and closing said outlets for selectively distributing air from said manifold to one or more of said air distributing channels or to said foaming air channel only.

2. An air bubbling mat, as claimed in claim 1, wherein said air inlet means to said manifold chamber comprises a coupling sleeve connection to the upper wall of said mat so as to direct air through the outlet of said manifold chamber in communication with said air distributing channels, and a second coupling sleeve connected to the lower wall of said mat so as to direct air through the manifold outlets in communication with the foaming air channels only, whereby, said mat is rendered reversible so that the upper side is used for the bubble bath and the lower side is used for the fullfoam bath to support the patient.

3. An air bubbling mat, as claimed in claim 1, wherein said inlet means comprises a pair of coupling inlets disposed on the upper wall of said mat, said pair of coupling inlets being disposed in communication with said manifold so that the air is distributed to one or more of the air distributing chambers when one of said pair of coupling inlets is connected to a source of compressed air, and to the air foaming channels only when the other of said pair of inlets is connected to the source of compressed air.

4. An air bubbling mat, as claimed in claim 1, and including a plurality of distance pieces disposed between said upper and lower walls to function as spacers to prohibit compressing of said mat when subjected to the weight of a patient.

* * * * *